US007682192B2

(12) United States Patent
Sawdy et al.

(10) Patent No.: US 7,682,192 B2
(45) Date of Patent: Mar. 23, 2010

(54) ELECTRICAL RECEPTACLE AND CIRCUIT BOARD WITH CONTROLLED SKEW

(75) Inventors: John F. Sawdy, Black Mountain, NC (US); Larry M. Crofoot, Perry, OH (US); John T. Venaleck, Painesville, OH (US)

(73) Assignee: Ohio Associated Enterprises, LLC, Painesville, OH (US)

( * ) Notice: Subject to any disclaimer, the term of this patent is extended or adjusted under 35 U.S.C. 154(b) by 0 days.

(21) Appl. No.: 12/327,978

(22) Filed: Dec. 4, 2008

(65) Prior Publication Data

US 2009/0149067 A1 Jun. 11, 2009

Related U.S. Application Data

(60) Provisional application No. 60/992,496, filed on Dec. 5, 2007.

(51) Int. Cl.
*H01R 13/648* (2006.01)

(52) U.S. Cl. ..... 439/607.05; 439/607.06; 439/607.07; 439/607.08

(58) Field of Classification Search ..... 439/607.05–607.08
See application file for complete search history.

(56) References Cited

U.S. PATENT DOCUMENTS 6,132,255 A * 10/2000 Verhoeven ..... 439/607.06
6,299,484 B2 * 10/2001 Van Woensel ..... 439/607.07
6,379,188 B1 * 4/2002 Cohen et al. ..... 439/607.07
6,979,226 B2 * 12/2005 Otsu et al. ..... 439/607.07

* cited by examiner

*Primary Examiner*—Tho D Ta
(74) *Attorney, Agent, or Firm*—Renner, Otto, Boisselle & Sklar, LLP

(57) ABSTRACT

An electrical coupler includes a connector receptacle having multiple modules. The modules each include a pair of signal conductors and a ground plane or shield, held together by a dielectric module body. The shields are between the pairs of conductors in adjacent modules, and provide electrical shielding between the pairs of signal contacts of different modules. The signal conductors and the shields may be coupled to a board, such as a circuit board. The receptacle may be an angled receptacle, such as a right angle receptacle. The signal conductors of each pair in the receptacle may have a predetermined amount of skew, having different effective electrical lengths. This may allow signal paths through the receptacle and the board to have a combined electrical path that is substantially the same for the signal conductor pair of one of the modules.

12 Claims, 5 Drawing Sheets

ELECTRICAL RECEPTACLE AND CIRCUIT BOARD WITH CONTROLLED SKEW

This application claims priority under 35 USC 119 from U.S. Provisional Application No. 60/992,496, filed Dec. 5, 2007, which is incorporated herein by reference in its entirety.

RELATED APPLICATIONS

Reference is made to U.S. Patent Application Pub. No. 2005/0112920 A1, published May 26, 2005, and to U.S. patent application Ser. No. 11/942,888, filed Nov. 20, 2007. Both of the above applications are hereby incorporated herein by reference in their entireties.

TECHNICAL FIELD

The invention is in the general field of electrical connectors.

SUMMARY OF THE INVENTION

According to one aspect of the invention, an angled electrical connector receptacle has a predetermined skew or difference in effective electrical length within a signal pair. The electrical receptacle may be a right angle electrical receptacle. The electrical receptacle may by modular, with pairs of signal conductors in each of the modules spaced apart from other pairs by intervening grounded conductive shield plates.

According to another aspect of the invention, a modular electrical connector receptacle has pairs of signal conductors in each of the modules, with pairs of signal conductors in each of the modules spaced apart from other pairs by intervening grounded conductive shield plates. The shield plates have protruding beams that in profile, overlap parts of the of the signal conductors, being wider than the signal conductors. This overlap aids in preventing electrical interference, such as crosstalk, between signal conductor pairs of different modules.

According to still another aspect of the invention, a modular electrical connector receptacle has pairs of signal conductors in each of the modules, with pairs of signal conductors in each of the modules spaced apart from other pairs by intervening grounded conductive shield plates. The ground plates have a pair of upper beams for contacting a first ground contact at two separate points, and a pair of lower beams for contacting a second ground contact at two separate points. By making contact with a ground contact at two separate points, using two separate beams, a large ground stub is avoided. This feature provides excellent electrical performance.

According to still another aspect of the invention, a modular electrical connector receptacle has pairs of signal conductors in each of the modules, with pairs of signal conductors in each of the modules spaced apart from other pairs by intervening grounded conductive shield plates. Protruding beams of the conductive shield plates may have narrower notched regions that preferentially bend when in contact with a ground contact on a board or a connector part. This feature allows a wider beam for shielding and yet enough compliance to make a reliable contact.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, which are not necessarily to scale.

DETAILED DESCRIPTION

An electrical coupler includes a connector receptacle having multiple modules. The modules each include a pair of signal conductors, upper and lower, and a ground plane or shield, held together by a dielectric module body. The shields are between the pairs of conductors in adjacent modules, and provide electrical shielding between the pairs of signal contacts of different modules. The signal conductors and the shields may be coupled to a board, such as a circuit board. The receptacle may be an angled receptacle, such as a right angle receptacle. The signal conductors of each pair in the receptacle may have a predetermined amount of skew, having different effective electrical lengths between upper and lower signals. This may allow signal paths through the receptacle and the board to have a combined electrical path that is substantially the same for each of the signal conductor pair of one of the modules. The ground contacts have multiple points of contact arranged to eliminate undesirable electrical stubs or stray capacitance, or the ground contacts have wide beams that shield the signals and a notched area to enhance mechanical compliance.

The shields of the receptacle may have beams of conductive material that extend similar to the signal conductors. The conductive material beams overlap the corresponding signal conductors, having a width within the plane of the shield that is greater than a width of the corresponding overlapped portions of the signal conductors. The conductive material beams may have notched or reduced width portions that allow for easier bending of the arms, to facilitate engagement of the arms with ground contacts on a board or electrical connector.

Figure 1:
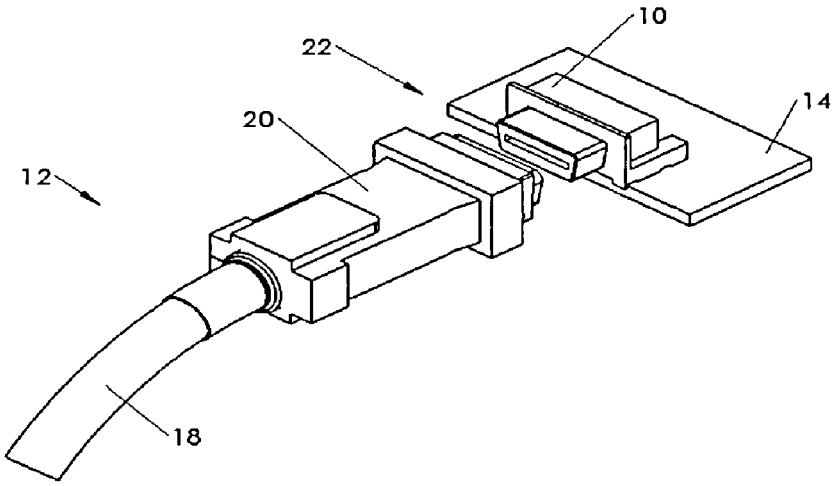
FIG. 1 is an oblique view of an electrical coupling in accordance with an embodiment of the invention.

Referring initially to FIG. 1, an electrical receptacle 10 is used to couple a cable assembly 12 to a circuit board 14. The electrical receptacle 10 is an angled receptacle, such as a right-angle receptacle. The cable assembly 12 includes a cable 18 that is connected to an electrical connector 20. The electrical connector 20 mates with the receptacle 10, allowing an electrical connection to be made between the wires of the cables 18 and conductive traces or contacts on the circuit board 14. The receptacle 10 and the cable assembly 12 together constitute an electrical coupling 22.

Figure 2:
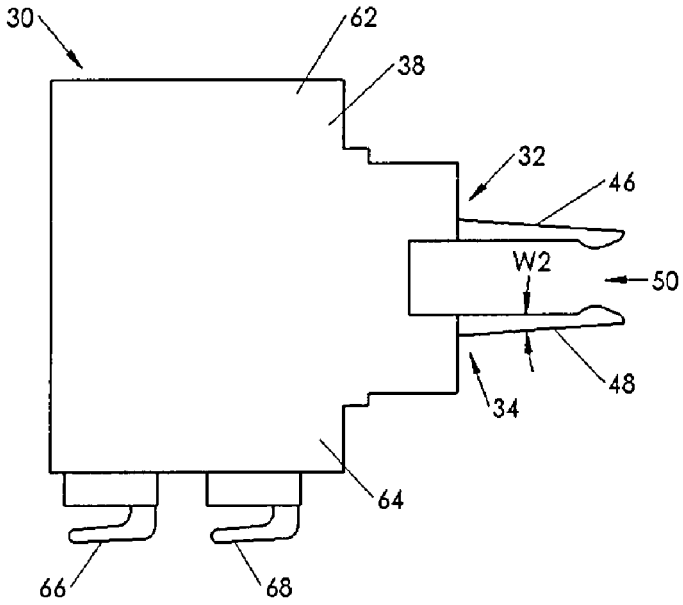
FIG. 2 is a side view of a module of an angled receptacle of the coupling of FIG. 1 containing a signal pair of contacts.
Figure 3A:
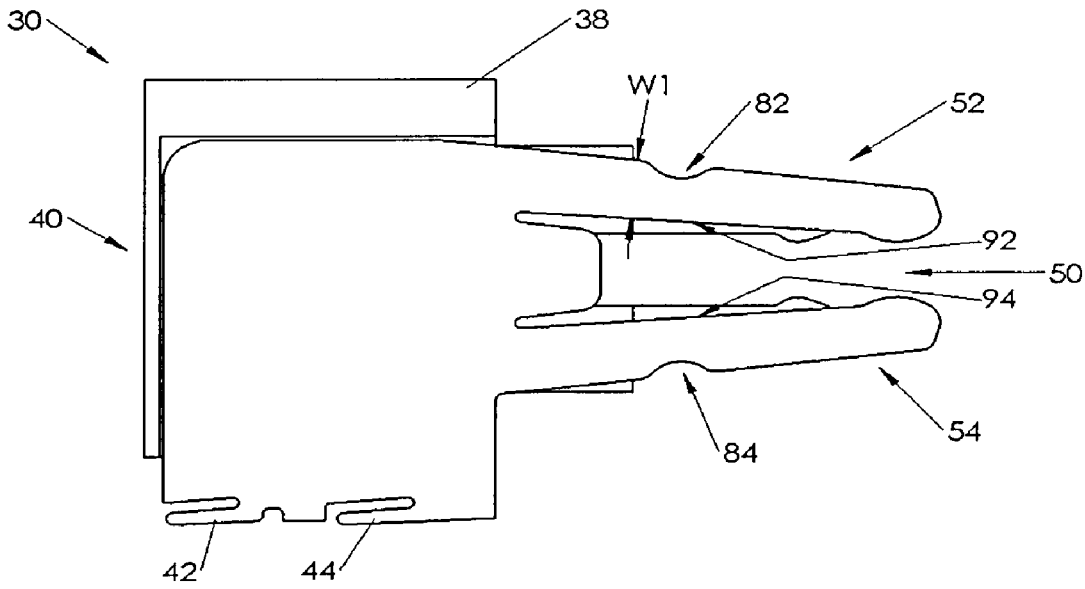
FIG. 3A is another side view of the module of the receptacle of FIG. 2, with the ground shield installed.
Figure 3B:
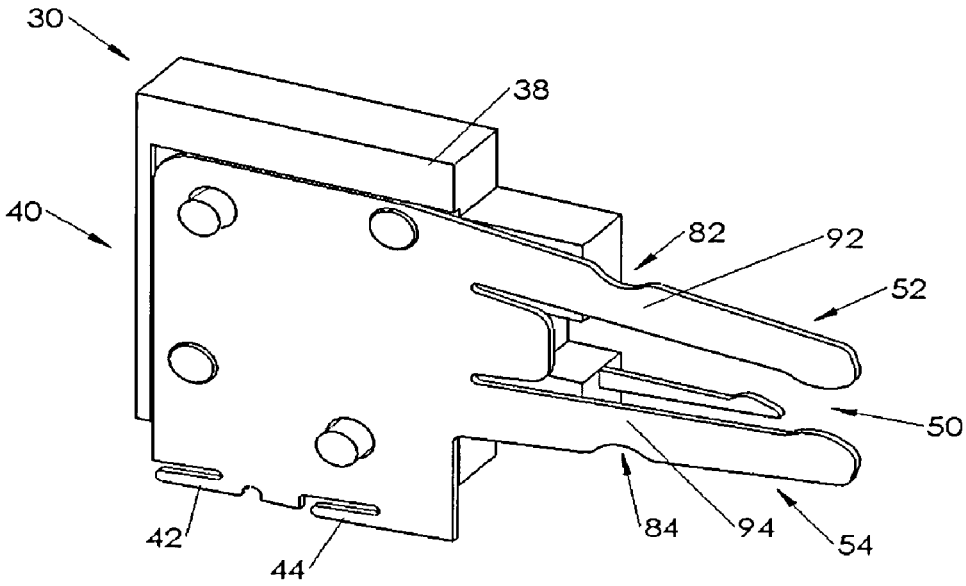
FIG. 3B is still another view of the module of the receptacle of FIG. 2, with the ground shield installed.

Referring now in addition to FIGS. 2, 3A, and 3B, the electrical receptacle 10 (FIG. 1) is a modular design. Only one of the modules 30 is illustrated in FIG. 2, but it will be appreciated that multiple of substantially-identical modules 30 may be stacked together including multiple modules 30 stacked together within a receptacle body to form the receptacle 10 (FIG. 1). Each of the modules 30 has a pair of signal conductors 32 and 34, which may be used to carry electrical signals. The signal conductors 32 and 34 may correspond to pairs of wires in the cable 18 (FIG. 1).

The conductors 32 and 34 are made of a suitable electrically conductive material, such as copper or a copper alloy. It will be appreciated that the modules 30 may have a different number and/or configuration of the conductors 32 and 34.

The conductors 32 and 34 are held in place by a dielectric material module body 38. The body 38 may made of a suitable dielectric material, such as any of a variety of well-known, moldable thermoplastic materials.

The module 30 also includes a ground plane or shield 40. The shield 40 is located between the conductor pairs 32 and 34 of adjacent modules 30. It provides electrical shielding between conductor pairs 32 and 34 of different modules. It will be appreciated that shielding the conductors 32 and 34 from effects of other nearby signal conductors prevents degradation of signals passing through the receptacle 10. Shielding may also enable use of a higher density of signal conductors while still maintaining good signal quality.

The shield 40 is made of an electrically conductive material, and may be made of the same material as the conductors 32 and 34. The shield 40 may be attached to the module body 38 by any of a variety of suitable mechanism, such as by heat staking. The shield 40 may be grounded by electrically connecting conductive tails 42 and 44 to ground contacts on the circuit board 14 (FIG. 1), or to another suitable grounded conductor. The shield 40 may have uniform thickness, and substantially all of the shield 40 may be in the same plane.

The conductors 32 and 34 have respective portions 46 and 48, for receiving a suitable end of the connector 20 (FIG. 1). The connector 20 may have a nose or plate that has a series of conductors on its top and bottom major surfaces. The nose or plate is inserted in a gap 50 between the conductors 32 and 34. The top conductor 32 makes contact with one of the conductors on the top surface of the nose or plate, and the bottom conductor 34 makes contact with one of the conductors on the bottom surface of the nose or plate.

The shield 40 has protruding arms 52 and 54 that engage other contacts on the top and bottom surfaces of the nose or plate of the connector 20. The arms 52 and 54 electrically couple the grounds of the cable assembly 12 and the circuit board 14. As discussed further below, the arms 52 and 54 also may be used to provide electrical shielding between the signal conductors 32 and 34 of different modules 30.

The electrical signals through the conductors 32 and 34 may be differential electrical signals. Differential electrical signals are commonly used in high-frequency circuits. Two parallel conductors can form a differential pair where a positive voltage signal is injected on one line and a negative voltage signal is injected on the other. Because the signals are of opposing polarity, their fields tend to cancel leaving almost no external fields that would cause crosstalk in adjacent conductors. It is important that the voltages across from each other be equal such that full cancellation occurs. If the signals are started at the same time and with the same absolute voltage, then it is desirable that the electrical length of the path is equal such that the signals arrive downstream at the same time. Signals that arrive not at the same time are said to have skew. The skew is usually measured in picoseconds. A typical path length might cause a delay of 100 picoseconds per inch of path. This delay is strongly affected by the dielectric constant of the media directly surrounding the conductor. Therefore, if the dielectric constant is changed, the speed of the signal will change and it will manifest itself in smaller or larger delays (smaller or larger skews).

Figure 4:
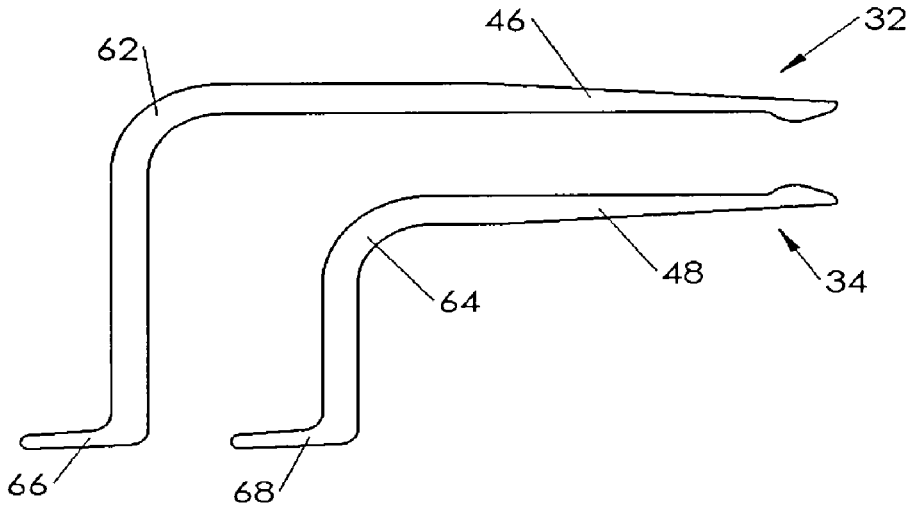
FIG. 4 is a side view of a pair of signal conductors of the module of FIGS. 2 and 3.

Referring to FIG. 4, where the conductors 32 and 34 are parallel and surrounded by a dielectric material, the conductors 32 and 34 are said to be coupled and impedance constant. The closer the conductors 32 and 34 get, the smaller the impedance, because the capacitance goes up as the space between the conductors 32 and 34 gets smaller.

If the conductors 32 and 34 are maintained as parallel throughout their bends 62 and 64, they have different mechanical path lengths. This difference can be adjusted for somewhat by adjusting the shape of the conductors so that they are no longer parallel during the bends 62 and 64. If this technique is used to adjust the electrical path length, the conductors 32 and 34 cannot be impedance controlled by coupling to each other. It is possible to have each signal coupled to ground, leaving it free to take any path so long as the electrical length is satisfied.

The conductors 32 and 34 have some predetermined value of skew, a different effective electrical length, that is compensated for by different effective electrical lengths in the paths taken by the signals in the circuit board 14. The effective electrical length is a function both of the mechanical length of the conductors 32 and 34, and of the dielectric material around the conductors 32 and 34.

Figure 5:
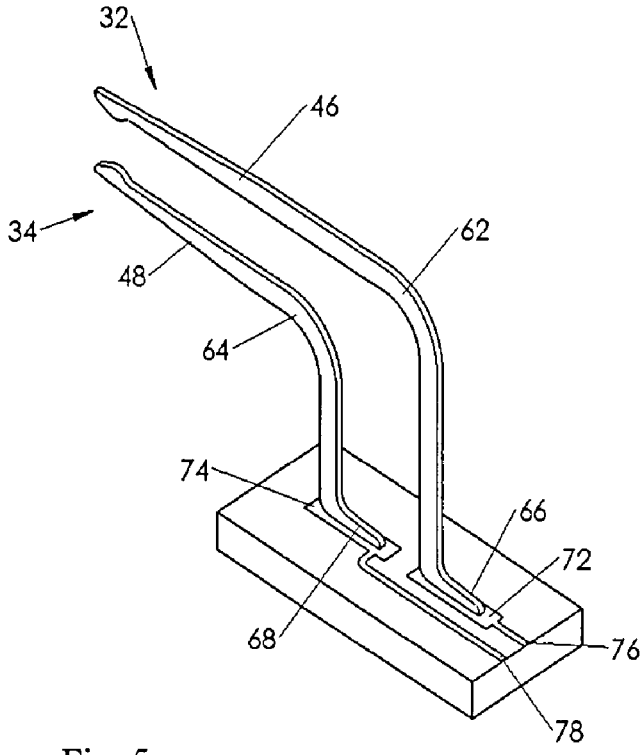
FIG. 5 is an oblique view showing coupling of the signal conductors of FIG. 4 to conductive traces on a circuit board.

With reference now in addition to FIGS. 4 and 5, the conductors 32 and 34 have compliant surface-mount tails 66 and 68 that are coupled to respective contact pads 72 and 74 on the circuit board 14. Conductive traces 76 and 78 couple the contact pads 72 and 74 to other components on the circuit board 14. The conductors 32 and 34 have a predetermined difference in effective electrical path length. However, the combined electrical path length of the conductor 32, the contact pad 72, and the conductive trace 76, is substantially equal to the effective electrical path length of the conductor 34, the contact pad 74, and the conductive trace 78. Each path has substantially the same sum of the mechanical path length in the receptacle times its dielectric constant plus the mechanical path length in the circuit board times its dielectric constant. The arrangement of the signal contacts 32 and 34 and the dielectric material body 38 may be chosen to achieve this equality of effective path length for a given circuit board configuration. One possible way of achieving this is by adjusting the configuration of the signal contacts 32 and 34. Another possibility is to adjust the dielectric constants to achieve the same results. One way to adjust the dielectric constant is to introduce air along the path (the absence of plastic dielectric) in order to achieve the average dielectric constant required. Another way is to vary the materials being used for the dielectric.

Figure 6:
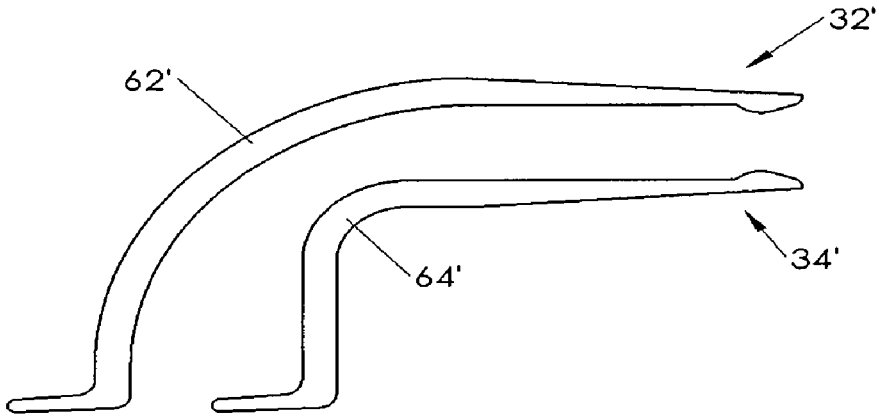
FIG. 6 is a side view showing an alternate configuration for the signal conductors.

The signal contacts 32 and 34 may be parallel or non-parallel. The angular extent of the bends 62 and 64 may be similar or different. FIG. 6 shows an alternative signal contact configuration wherein contacts 32' and 34' are non-parallel in their bend regions 62' and 64', and wherein the bends 62' and 64' have different radii to control the mechanical path length.

The signal contacts 32 and 34 may be electrically coupled to the shield such that any non-parallel parts of the signal contacts 32 and 34 do not have a significant adverse electrical effect. By electrically coupling the conductors 32 and 34 to the shield 40, there may be little mutual coupling.

Referring back to FIGS. 2 and 3, the protruding shield arms 52 and 54 overlap and provide shielding to the signal conductor portions 46 and 48. The shield arms 52 and 54 have width W1 within the plane of the shield 40 that is greater than as width W2 of corresponding parts of the straight portions 46 and 48. Thus the shield arms 52 and 54 extend above and below the straight portions 46 and 48. This overlap provides better shielding than if the arms 52 and 54 had the same width of the straight portions 46 and 48.

It will be appreciated that the overlapping arms 52 and 54 are stiffer than the narrower straight portions 46 and 48. Notches 82 and 84 are provided in the arms 52 and 54. The notches 82 and 84 provide reduced-width arm sections 92 and 94 where the arms 52 and 54 preferentially bend when pushed apart. This allows the arms 52 and 54 to bend apart and engage a connector board or plane inserted between them.

Figure 7:
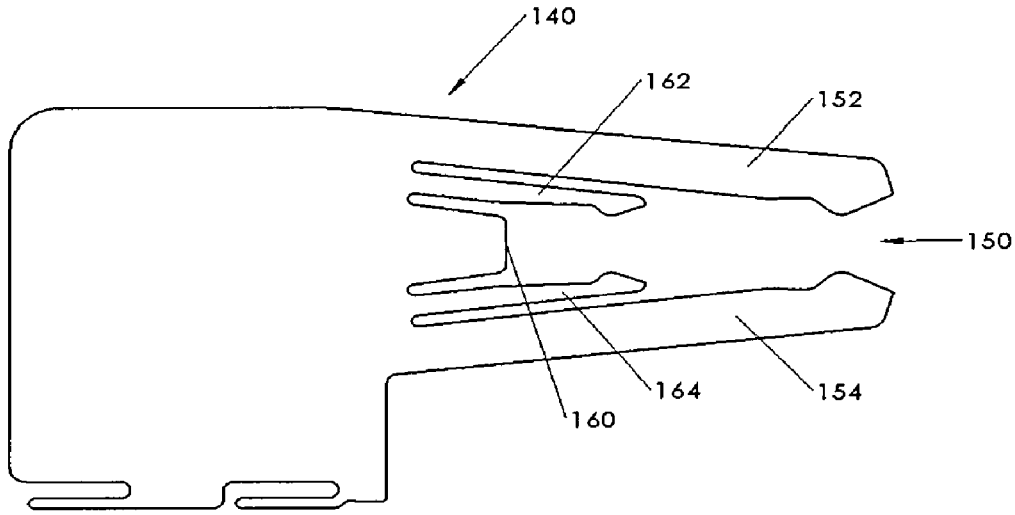
FIG. 7 is a side view of an alternate configuration for the conductive shield of the receptacle.
Figure 8:
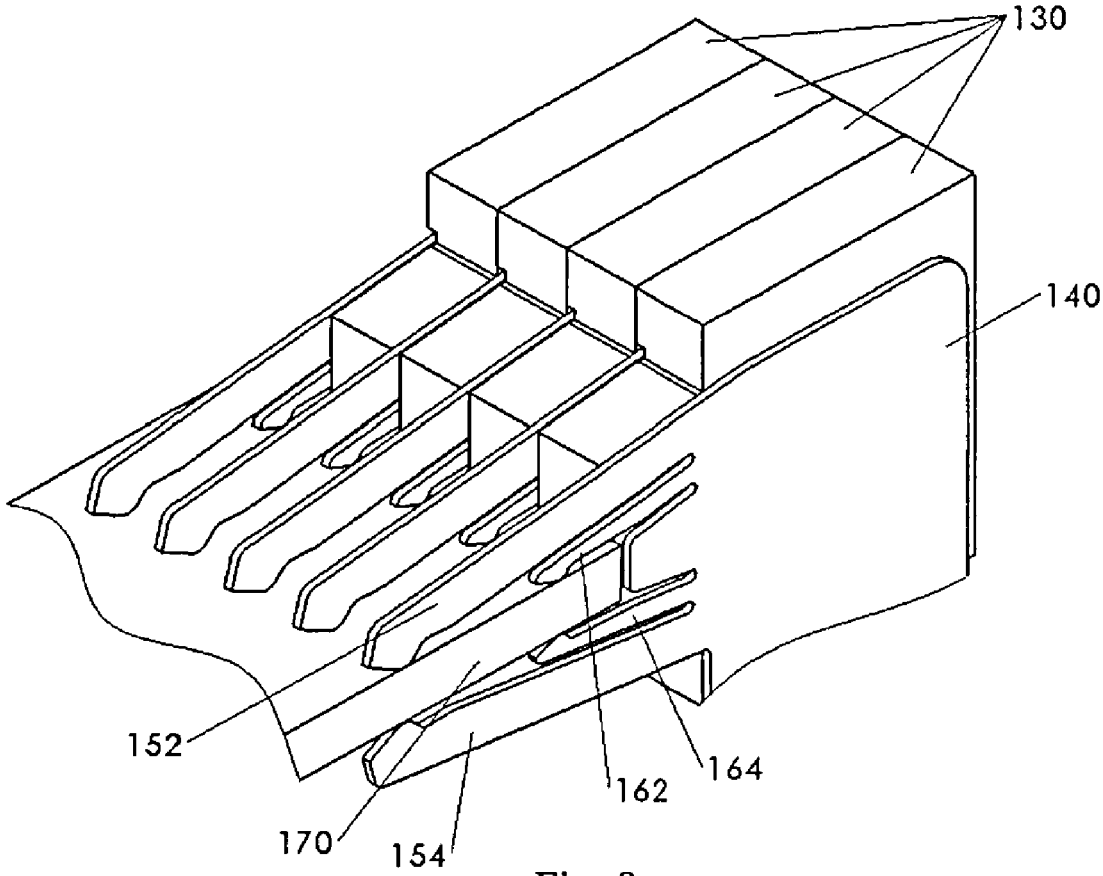
FIG. 8 is an oblique of receptacle modules using the conductive shield of FIG. 7.

FIG. 7 shows an alternative configuration shield 140 that has two pairs of arms for engaging ground contacts at different locations. The arms engage a board, plane, or other connector part inserted in a gap 150 between upper and lower arms. The outer arms 152 and 154 engage the top and bottom surfaces of the board, plane or other connector part at a relatively large distance from a stop 160 that limits insertion of the connector board or plane into the gap 150. The inner arms 162 and 164 engage the same contacts of the connector board or plane closer to the stop 160. This is shown in FIG. 8, with a number of modules 130 having shields 140 that engage a portion of a male connector 170 inserted into the gap 150. The result is four points of contact between the conductive shield 140 and ground contacts of the electrical connector portion 170. The second pair of contacts, from the inner arms 162 and 164, make contact at the very end of the insertion of the male connector portion 170, to provide a current path to the leading ends of the male ground contacts. This eliminates a capacitive stub in the male ground contacts that can cause resonances in the ground circuit. Such resonances could create undesirable electrical performance.

It will be appreciated that many variations are possible for the above connector. The concepts described may be applied in different types of electrical connectors having different configurations.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. In combination, an angled board mount receptacle and a circuit board, the combination comprising:

the angled board mount receptacle, including:

a conductive shield; and a pair of electrical conductors that are electrically coupled to the conductive shield;

wherein the electrical conductors have predetermined skew (difference in effective electrical path lengths); and the circuit board, wherein the circuit board includes a pair of conductive traces, and a pair of conductive pads electrically coupled to respective of the conductive traces and to respective of the electrical conductors;

wherein one of the electrical conductors, one of the conductive pads, and one of the conductive traces together constitute a first electrical path;

wherein the other of the electrical conductors, the other of the conductive pads, and the other of the conductive traces together constitute a second electrical path; and wherein the electrical paths have substantially the same effective electrical path lengths (mechanical path length times average dielectric constant), while having different mechanical path lengths.

2. In combination, an angled board mount receptacle and a circuit board, the combination comprising:

the angled board mount receptacle, including:

plural modules mechanically coupled together, each of the modules including:

a conductive shield; and a pair of electrical conductors that are electrically coupled to the conductive shield;

wherein the electrical conductors have a predetermined skew (difference in effective electrical path lengths); and the circuit board, wherein the circuit board includes a pair of conductive traces, and a pair of conductive pads electrically coupled to respective of the conductive traces and to respective of the electrical conductors;

wherein, for each of the modules, one of the electrical conductors, one of the conductive pads, and one of the conductive traces together constitute a first electrical path;

wherein, for each of the modules, the other of the electrical conductors, the other of the conductive pads, and the other of the conductive traces together constitute a second electrical path; and wherein, for each of the modules, the electrical paths have substantially the same effective electrical path lengths (mechanical path length times average dielectric constant), while having different mechanical path lengths.

3. The combination of claim 2, wherein the receptacle is a right angle receptacle.

4. The combination of claim 2, wherein the electrical conductors are angled.

5. The combination of claim 2, in combination with an electrical connector mated with the receptacle.

6. The combination of claim 2, wherein the conductive shield has tails for soldering to the circuit board; and wherein the tails of the conductive shield are directly in line with signal contact tails of the electrical conductors, to preserve shielding and impedance all the way to the circuit board.

7. The combination of claim 2, wherein the conductive shields have beams wider than the adjacent electrical conductors, providing overlap with the electrical conductors.

8. The combination of claim 7, wherein the beams protrude from a conductive shield main body.

9. The combination of claim 2, wherein, for each of the modules, the conductive shield has four (4) or more ground contacts to mate with a companion male ground contact of a cable assembly that is matable to receptacle; and wherein at least one of the contacts on each of the conductors of the module is close to the end of the male ground contact.

10. The combination of claim 9, wherein for each of the conductive shields the ground contacts include at least two upper ground contacts above a male-ground-contact-receiving area for receiving the mile ground contact, and at least two lower ground contacts below the male-ground-contact-receiving area.

11. The combination of claim 7, wherein the beams of the conductive shields have notched areas near their origin; and wherein the overlap at the notched areas is reduced relative to the overlap over other areas of the beams.

12. The combination of claim 11, wherein the beams preferentially bend at the notched areas.

* * * * *